United States Patent [19]

Hart

[11] 4,340,010

[45] Jul. 20, 1982

[54] INTERNAL GIRTH COATING APPARATUS

[75] Inventor: Robert J. Hart, Tulsa, Okla.

[73] Assignee: Commercial Resins Company, Tulsa, Okla.

[21] Appl. No.: 253,702

[22] Filed: Apr. 13, 1981

[51] Int. Cl.[3] ..... B05C 7/02; B05C 19/00

[52] U.S. Cl. ..... 118/306; 118/308; 118/323; 118/DIG. 10

[58] Field of Search ..... 51/411; 118/306, DIG. 10, 118/323, 308, 105; 15/312 R, 316 R

[56] References Cited

U.S. PATENT DOCUMENTS

| | | | |
|---|---|---|---|
| 2,140,298 | 12/1938 | Miller | 118/306 X |
| 3,810,441 | 5/1974 | Padgett et al. | 118/105 |
| 3,989,006 | 11/1976 | Estebanez et al. | 118/306 |
| 4,092,950 | 6/1978 | Hart | 118/306 X |

*Primary Examiner*—John P. McIntosh

*Attorney, Agent, or Firm*—William S. Dorman

[57] ABSTRACT

An internal pipe coating apparatus for coating the interior surfaces of uncoated weld joints in an otherwise internally coated pipeline comprising a frame movable longitudinally along the interior of the pipeline, the frame having a shaft at its forward end and disposed generally along the longitudinal center line of the pipeline, a coating assembly comprising a pair of horizontally spaced arms mounted for rotation on the shaft and extending radially outward on opposite sides thereof, a pair of spaced parallel links having their inner ends pivotally connected to the outer ends of the arms and having their outer ends pivotally connected to a pair of triangularly shaped mounting plates, each mounting plate being in the shape of an obtuse isosceles triangle having a single obtuse angle and a pair of smaller acute angles, each mounting plate being pivotally connected to its associated link at the apex of the obtuse angle, a wheel mounted on each mounting plate at the location of each acute angle thereof, a hollow powder applicator head mounted on each mounting plate and having a dispensing opening oriented in a direction away from the shaft and parallel to the longitudinal axis of the pipeline, a hose for supplying an air powder mixture to each powder applicator head, a piston-cylinder unit operatively connected to each pair of links intermediate the ends thereof and operatively connected to the pair of arms adjacent the shaft, a conduit for introducing fluid under pressure into each piston-cylinder unit to extend the same so as to pivot the links outwardly away from the shaft until the wheels contact the inner surface of the pipeline and the dispensing opening of each applicator head is positioned adjacent the weld joint.

5 Claims, 9 Drawing Figures

INTERNAL GIRTH COATING APPARATUS

BACKGROUND OF THE INVENTION

1. Field of the Invention

The present invention relates to an internal coating apparatus and, more particularly, to a coating apparatus designed to coat uncoated weld joints on the interior of an otherwise coated pipeline.

2. The Prior Art

My prior U.S. Pat. No. 4,092,950 discloses an internal pipe coating apparatus which includes a hollow rotating shaft, a hollow hub and a plurality of hollow radiating arms projecting out from the hub and adapted to spray powder on an uncoated weld joint. However, the openings in the hollow radiating arms are relatively small and they are fixed in radial position with respect to the hollow shaft.

SUMMARY OF THE INVENTION

The present invention relates to an internal coating apparatus for coating the uncoated weld joints in the interior of an otherwise internally coated pipeline. The apparatus includes a frame which is supported by wheels at the forward and rear ends thereof. A coating assembly is mounted at the forward end of the frame. Means are provided for driving the rear wheels so that the apparatus can be moved along the interior of the pipeline to position the coating assembly opposite an uncoated weld joint. The forward coating section is provided with a shaft which is disposed generally along the longitudinal center line of the pipe. A coating assembly is rotatably mounted on the shaft, and this coating assembly comprises a pair of horizontally spaced arms mounted for rotation on the shaft and disposed in substantially parallel relation with each other. Each arm extends radially outward from the shaft on opposite sides thereof and terminates in a pair of opposite ends. A plurality of horizontally extending spacer bars are disposed along the links of the arm for connecting the arms together whereby they will rotate in unison about the shaft. A first pair of spaced parallel links and having a pair of inner ends are pivotally connected at their inner ends to one pair of opposite ends of the arms. Each pair of spaced parallel links is also provided with outer ends which are pivotally connected to a pair of triangularly shaped mounting plates. The mounting plates are arranged in spaced parallel relation to each other, and each mounting plate is in the shape of an obtuse isosceles triangle having a single obtuse angle and a pair of smaller acute angles. Each mounting plate is pivotally connected to its associated link at the apex of the obtuse angle of the mounting plate. A wheel is mounted on each mounting plate at the location of each acute angle thereof. Cross bars are connected across the mounting plates so that each pair of mounting plates will pivot as a unit about the outer ends of the links. Each pair of mounting plates is provided with a tranversely extending applicator head bracket. A hollow powder applicator head is connected to each applicator head bracket, and each applicator head has a dispensing opening oriented in a direction away from the shaft and extending parallel to the longitudinal axis of the pipeline. A hose is connected to each powder applicator head for supplying an air powder mixture to the applicator head.

A piston-cylinder unit is operatively connected between each pair of links and the pair of arms. That is, each piston-cylinder unit has one end operatively connected to a pair of links intermediate the ends thereof; each piston-cylinder unit has a second end operatively connected to the pair of arms adjacent the shaft. A conduit for supplying air under pressure is connected to each piston-cylinder unit so as to extend the same whereby the links pivot outwardly away from the shaft until the wheels contact the inner surface of the pipeline at which time the dispensing openings on the applicator heads are adjacent the weld joint. When this condition is achieved, the air powder mixture can be applied from the applicator head to the weld joint which has been previously heated so as to coat the weld joint. A motor is provided for rotating the arms through suitable sheaves and a V-belt so that the arms can rotate at least 180° around the shaft. Since the applicator heads are located 180° apart from each other, more than 180° rotation of the arms is unnecessary.

Suitable control means are provided to move the apparatus along the pipe and to stop the apparatus when the coating assembly is adjacent an uncoated weld joint. The details of these controls are not deemed necessary for an understanding of the present invention. Any suitable mechanical, electrical or radio-active means (not shown) can be used to stop the apparatus at the proper location. If desired something similar to what is shown in my prior U.S. Pat. No. 4,092,950 can be employed to properly position the coating apparatus in relation to the uncoated weld joint.

DETAILED DESCRIPTION OF THE PREFERRED EMBODIMENTS

Figure 1A:
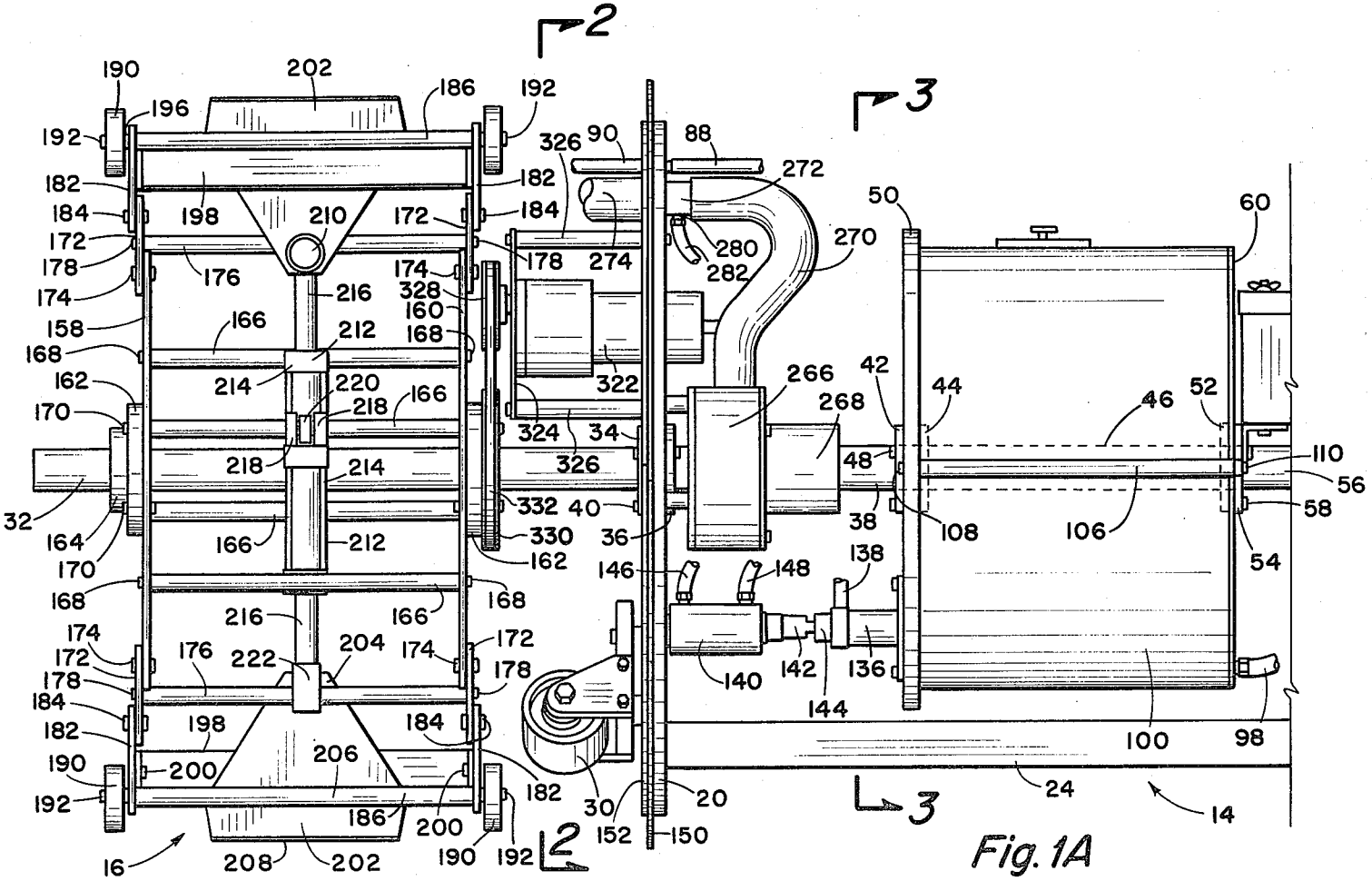
FIGS. 1A through 1C, together, represent a front side elevation, with certain parts broken away for clarity, of an internal girth weld coating apparatus constructed in accordance with the present invention.

Before referring to the drawings, it should be mentioned, first of all, that the internal girth weld coating machine illustrated herein is broadly similar to the machine shown in my prior U.S. Pat. No. 4,092,950. The basic difference between the present invention and that disclosed in above-mentioned patent is in the design and arrangement of the spray heads which are best shown in this application in FIGS. 1A and 5, as will be described hereinafter.

Figure 1B:
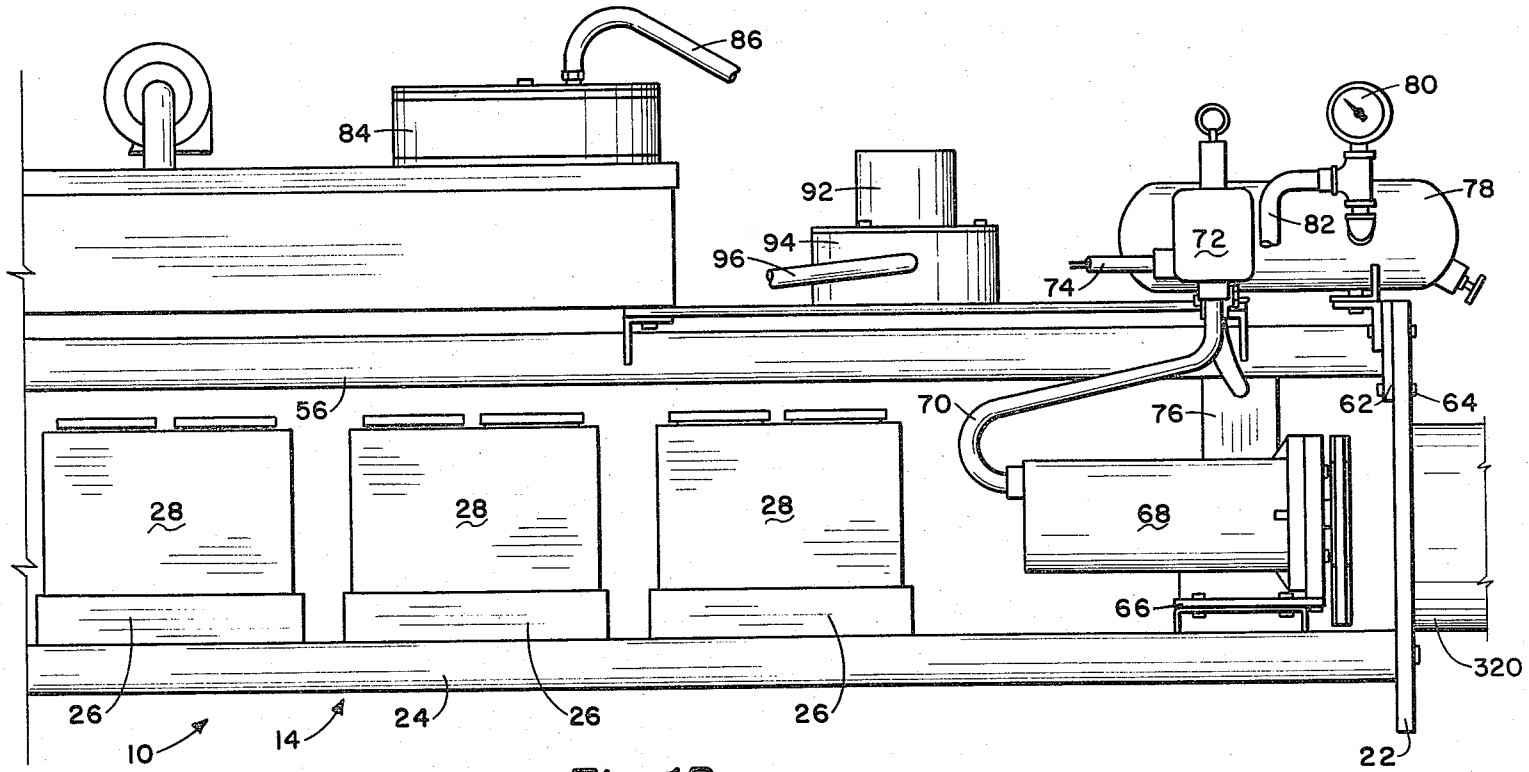
Figure 1C:
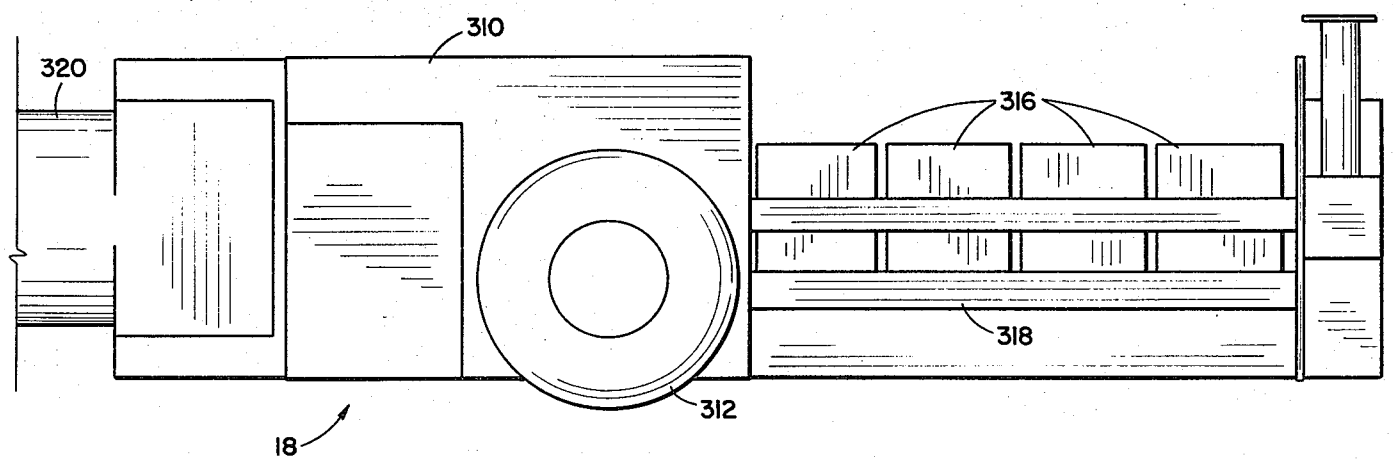

Referring now to the drawings in detail, FIGS. 1A through 1C show an internal coating device generally designated by the reference character 10 and located inside a pipe 12 (see FIG. 2), whose internal weld joints are to be coated. The coating apparatus 10 can be conveniently subdivided into a center carriage section 14 (FIGS. 1A and 1B), a forward rotatable coating section 16 (FIG. 1A), and a rear drive portion or crawler section 18 (FIG. 1C). With regard to the center carriage section 14, this is comprised basically of a forward circular carriage end plate 20 and a smaller rear carriage end plate 22 which are connected together to form a relatively rigid structure by means of four elongated frame members 24, (only one of which is shown in FIGS. 1A and 1B), which are suitably connected to the forward plate 20 and the rear plate 22 by means of a plurality of screws which pass through the end plates and are received in suitable threaded holes at the ends of the frame members 24. Preferably, two frame members are located adjacent the bottom in substantial horizontal alignment and two additional (not shown) frame members 24 are spaced adjacent the top of the rear plate 22 and extend horizontally forwardly to be connected at an appropriate location on the forward plate 20. Welded across the two lower frame members 24 are three horizontal trays 26, each of which is adapted to support two batteries 28, making a total of six batteries for powering the apparatus 10. On the forward surface of the carriage front end plate 20 are mounted three wheels 30 which support the forward end of the carriage in substantially the same manner as the wheels 38 and 40 shown in prior U.S. Pat. No. 4,092,950. Further discussion of the wheel supports is, therefore, deemed unnecessary.

A front center pipe 32, having a rear flange 34, is adapted to be bolted to a forward flange 36 located at the forward, or left hand, end of an intermediate pipe 38, (as will be explained hereinafter), by means of a plurality of bolts 40 which extend through the flanges and through appropriate holes in the front carriage end plate 20. The rear end of the intermediate pipe 38 is provided with a rear flange 42 which is adapted to be connected to a front flange 44 of a fluid bed center pipe 46 (whose purpose will be described hereinafter) by means of a plurality of screws 48 which extend through appropriate holes in the flange 42, through appropriate holes in a fluid bed front plate 50 (whose purpose will be hereinafter explained) and into threaded holes in the flange 44. Similarly, the rear end of the fluid bed center pipe 46 is provided with a rear flange 52 which is adapted to be connected to a forward flange 54 on a rear center pipe 56. The flanges 52 and 54 are connected together by means of screws 58 which extend through holes in the flange 54 through holes in a fluid bed back plate 60 (whose purpose will be described hereinafter) and into threaded holes in the flange 52. The rear end of the rear center pipe 56 is provided with a flange 62 which is connected to the carriage rear plate 22 by means of a plurality of bolts 64 which connect through the flange and the plate.

The rear end of the carriage just forward of the end plate 22 (see FIG. 1B) is provided with a horizontal support 66 for supporting thereon an electric motor 68. The motor connects by means of wires 70 through an electric switch 72 and through wires 74 to the batteries 28 in any convenient manner. It should be understood that the entire coating apparatus 10 is provided with various electrical and pneumatic controls for operating the various pneumatic and electrical components in timed sequence to the coating operation; however, the details of such controls are not necessary to an understanding of the present invention and therefore are not further described herein. The motor 68 drives a compresser 76 (only a portion of which is visible in FIG. 1B) through various gears, sheaves, pulleys, etc., which are considered to be conventional and are therefore not further described herein. The compresser 76 has its output connected to an air tank or reservoir 78 whose pressure can be determined visually by gauge 80. An output line 82 from the air tank 78 is adapted to connect to several of the pneumatic elements mounted on the coating apparatus 10; for example, the hose 82 can connect directly or indirectly to a control, thence to the side of an air filter 84 (in a manner not specifically shown); the air filter 84 has an outlet hose 86 which can connect in any convenient manner to a forward air hose 88 (see FIG. 1A) which connects through the plate 20 to another forward hose 90 for supplying pressure, ultimately, to the cylinders (later to be described) which position the spray heads (later to be described).

A blower 92 (see FIG. 1B) mounted on a blower housing 94 which, in turn, is supported on the carriage frame provides a supply of air under pressure from a hose 96. This hose 96 connects with another hose 98 (see FIG. 1A) adjacent the bottom of a fluidization chamber 100 (later to be described) directly or indirectly through any convenient controls, as desired.

Figure 4:
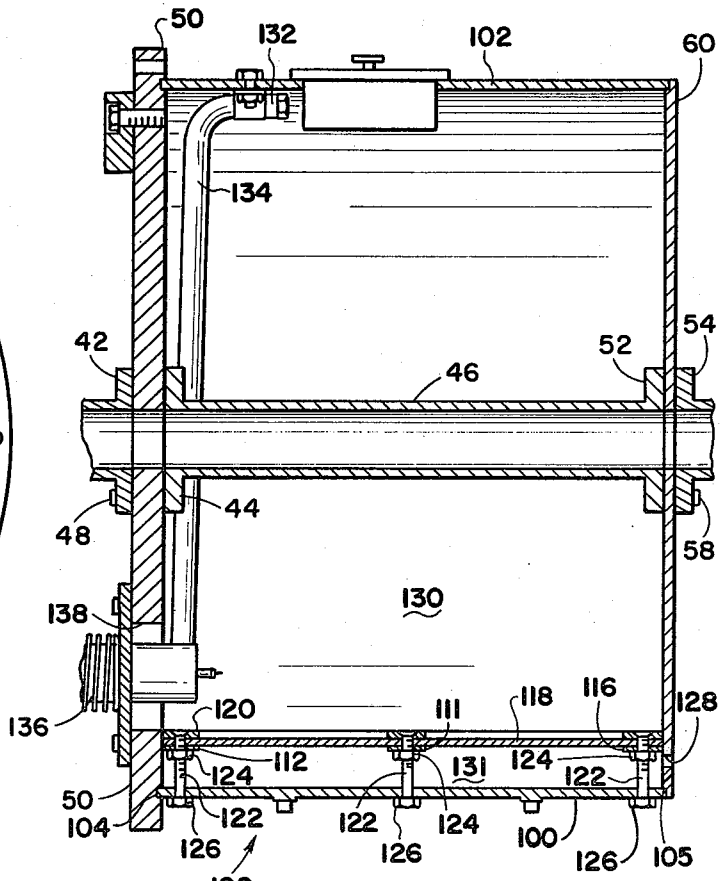
FIG. 4 is longitudinal cross-sectional view of the powder fluidization chamber shown in FIG. 1A.
Figure 3:
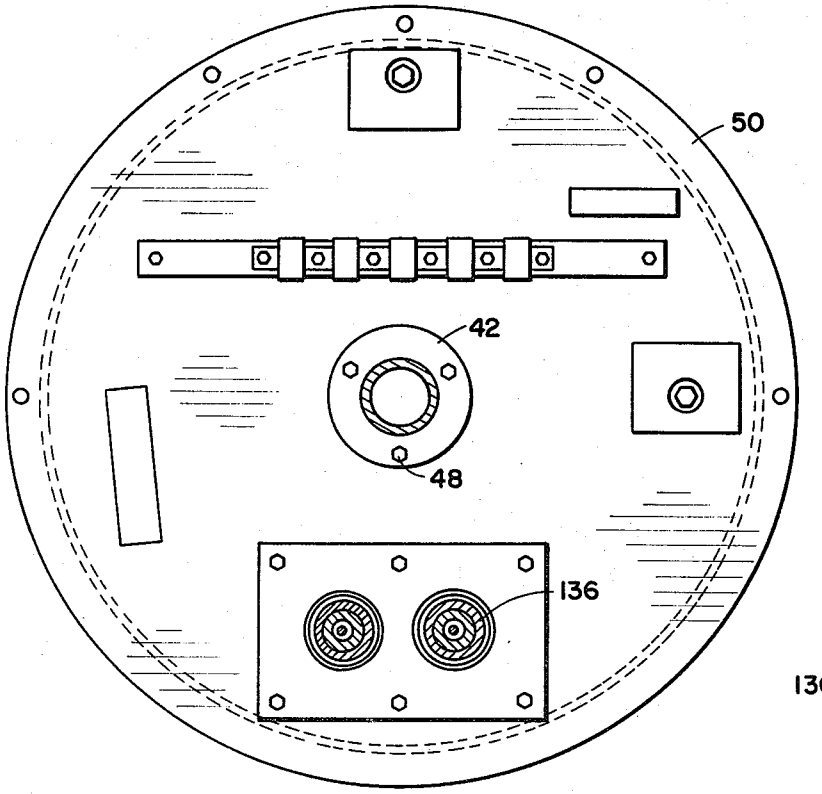
FIG. 3 is an another intermediate end elevation viewed along line 3—3 of FIG. 1.

Turning now to a consideration of FIG. 4 which shows the internal details of the fluidization chamber 100, this fluidization chamber is broadly similar to that disclosed in co-pending application Ser. No. 177,086 filed Aug. 11, 1980 and entitled "System for Spraying Powder Circumferentially Around a Pipe". The two fluidization chambers are similar in that they are essentially cylindrical in shape; however, the basic difference is that the cylindrical chamber 100 in the present application is supported along a central horizontal axis whereas the cylindrical fluidization chamber 30 in the prior co-pending application Ser. No. 177,086 is supported on a central vertical axis.

Returning now to a further consideration of FIG. 4 of the present application (as well as FIG. 1A), the fluidization chamber 100 is generally in the form of a cylindrical metallic sheet 102 which is supported between the fluid bed front plate 50 and the fluid bed back plate 60. That is, the front plate 50 is provided with a circular groove 104 in which the left hand end of the sheet 102 is received. The end plate 60 is likewise provided with a continuous annular recess or shoulder 105 in which the right hand end of the sheet 102 fits. Thus, the cylindrical metal sheet is held between the end plates 50 and 60; in order to assist in holding the plates in position over and above the center pipe 46, previously described, there are provided two clamping bars or rods 106, one on each side of the fluidization chamber 100, which extend between the plates 50 and 60 and which are attached thereto by means of nuts 108 and 110 which pass through suitable holes in the plates and are received in threaded holes in the rods 106, as best shown in FIG. 1A.

Within the fluidization chamber 100 (FIG. 4) adjacent the curved bottom thereof is located a fluidization membrane back-up plate 111. This plate is in the form of a rectangle which has two large rectangular openings 112 and 116 therein. Immediately above the back-up plate 111 is located a membrane 118 which is very similar to the membrane 100 described in prior co-pending application Ser. No. 117,086 filed Aug. 11, 1980, and which divides the main chamber 100 into an upper chamber 130 and a lower chamber 131, above and below the membrane respectively. The fluidization membrane 118 is made of porous plastic material which has pores so small that the coating powder positioned in the chamber 130 above the membrane is unable to pass through the pores; on the other hand the pores are large enough that air can pass through the membrane so as to suspend powder within the upper fluidization chamber. Above the membrane 118 is positioned a retainer plate 120 which is shaped similar to the back-up plate 111. The plates 111, 120, and the bottom of the sheet 102 are provided with aligned openings through which screws 122 are permitted to pass. The upper ends of the screws 122 are flat-headed as shown so as to be flush with the top of the retainer plate 120; however, locking nuts 124 are positioned immediately below the bottom of the back-up plate 111 so as to hold the plates 111 and 120 in position with the membrane 118 sandwiched therebetween. Screws 122 are provided with nuts 126 at the lower ends thereof.

At the right hand side of the fluidization chamber 100 adjacent the lower end thereof, the plate 60 is provided with an opening 128 to which the hose 98, previously described, is attached. This opening 128 permits air to pass into the lower chamber 131 beneath the membrane 118. This air, which is low pressure air from the blower 92, passes upwardly through the membrane and bubbles up through the powder in the area 130 above the membrane causing the powder to fluidize in this area. Air is trapped in the chamber above the powder, subsequently building up to a pressure of between 2–3 p.s.i. in the upper chamber 130. This upper chamber is also provided with a pair of internal fixed orifices 132 which are mounted on the upper curved portion of the sheet 102; only one such orifice is shown in FIG. 4, but it should be understood that an additional orifice is located in position directly behind the one that is shown. Also, there are provided a pair of metering hoses 134 (only one of which is shown). The lower end of each metering hose is connected to a forward portion of a powder valve 136 (only one of which is shown). These valves 136 are arranged in side by side relationship and extend through an opening 138 at the lower end of the plate 50 above the membrane 118. These valves 136 are essentially the same as the powder valves 32 and 34 disclosed in my prior co-pending application Ser. No. 177,086 and will not be further described herein except to state that their internal construction and operation is such as to provide a metered and predetermined quantity of powder exiting from the delivery lines 138, only one of which is shown; however, it should be understood that there are two delivery lines, one for each valve 136 to supply powder, respectively, to the two spray heads which will be described hereinafter.

Figure 2:
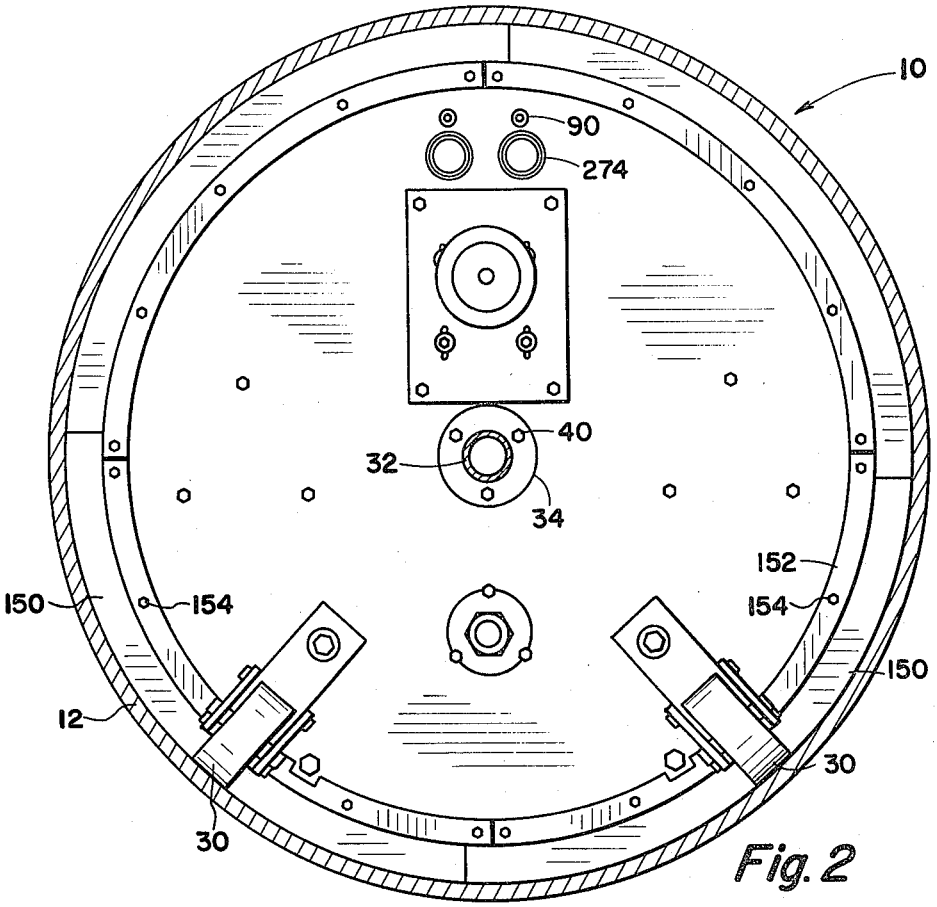
FIG. 2 is an intermediate end elevation viewed along line 2—2 of FIG. 1.

In my prior co-pending application Ser. No. 177,086, the valves corresponding to the valves 136 disclosed herein were operated by a brake bisquet; however, in the present case, these valves are operated by an air cylinder 140 (see FIG. 1A) which is mounted on the rear surface of the plate 20 and which is provided with a rearwardly projecting piston rod 142 that connects with a cross bar 144 so as to operate the two powder valves 136 in parallel. In order to operate the air cylinder 140 and, hence, the powder valve 136, air is introduced through a hose 146 on the left side of the air cylinder 140. The pressure through the hose 146 which is created in response to a control signal through the control circuit (not shown or described) actuates the piston 142 to move towards the right. Another hose 148 is attached to the right of the air cylinder 140 and this hose is preferably connected to a dampening means (not shown) to dampen the actuation of the air cylinder 140. A rubber sealing ring 150 (preferably split) is attached to the forward surface of the circular plate 20 and is held in position by two or more arcuate retainers 152 which are secured to the forward face of the ring 20 by a plurality of screws 154 as shown in FIG. 2. The rubber ring 150 extends outwardly beyond the periphery of the circular end plate 20 and contacts the inner surface of the pipe 12 so as to provide a seal between the forward coating area 16 and the center carriage section 14 to the rear of the plate 20.

Figure 5:
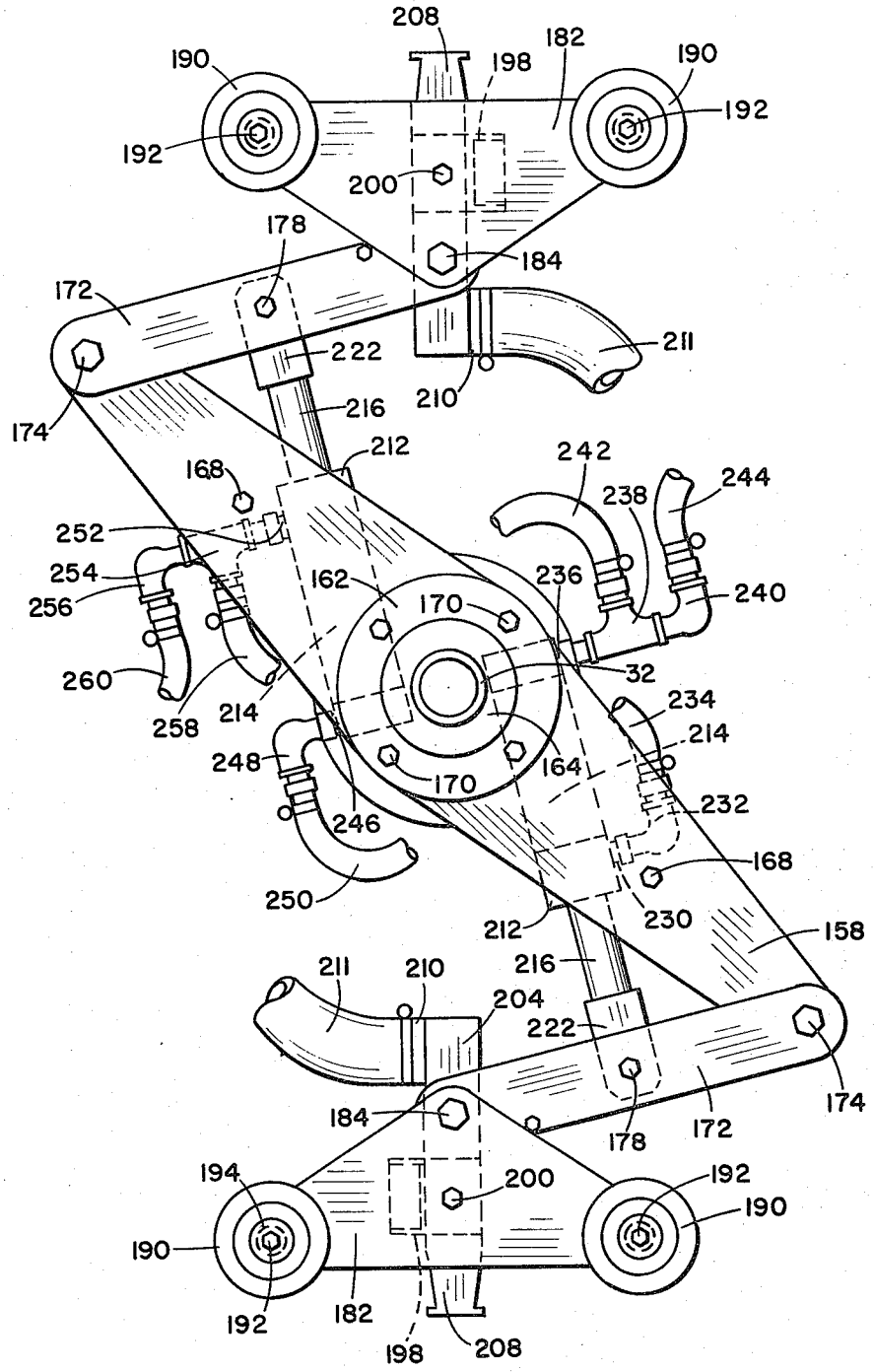
FIG. 5 is a left-hand end view of the powder applicator head arrangement shown in FIG. 1A.

Turning now to a consideration of FIGS. 1A and 5 together, the forward coating section 16 is comprised of a forward wheel side plate or arm 158 and a rear wheel side plate or arm 160. The arms 158 and 160 extend radially outward from both sides of the front center pipe 32 and are provided with central openings (not shown) therein for mounting of these arms on the front center pipe 32. Each arm, 158 or 160, is provided with a central bearing housing 162 mounted on each arm surrounding the central opening thereof to permit rotation of these wheel arms around the forward center pipe 32. Additionally, a pair of retainers 164 (only one of which is shown because the rear retainer is behind structure on the drawing) is attached to the forward center pipe 32 to hold the arms 158 and 160 in longitudinal position on the center pipe 32. In order to support the arms 158 and 160 in proper position with respect to each other, there are four spacer bars 166 which extend between the two arms along the lengths thereof. The radial outermost bars 166 are simply attached to the arms 158 and 160 by means of screws 168 which pass through convenient holes in the arm 158 and 160 and are received in threaded holes at the ends of the spacer bars 166. The radially innermost bars 166 are on opposite sides of the pipe 32 from each other and in a plane substantially at right angles to the longitudinal center line of the arms. These radial innermost spacer bars 166 are connected through the bearing housings by means of screws 170 (only two of which are shown) which pass through aligned holes in the bearing housings and in the arms 158 and 160 and are received in threaded holes in the ends of the spacer bars 166.

At each opposite end of the arms 158 and 160 are a pair of spaced links 172 which are pivotally connected at their inner ends to the arms by means of bolts 174 which permit free swinging movement of the links 172 with respect to the ends of the arms 158 and 160. The links 172 of each spaced pair of links are connected to each other by means of link spacer bars 176 which extend across the links and are connected at their ends by means of screws 178 which pass through suitable holes in the links and into threaded holes in the ends of the link spacer bars. An applicator mounting plate 182 is pivotally connected at the outer free end of each link 172. Each applicator mounting plate (there are four in number) is shaped in the form of an obtuse isosceles triangle (see FIG. 5). The apex of the large angle of the resulting triangular shape is pivotally connected to the outer end of each link by means of bolts 184. Four spacer bars 186 (see FIG. 1A) extend across and connect with the ends of the triangular plates 182 and these spacer bars also provide means for supporting eight wheels 190 at the outside corners of the triangular plates 182. Each wheel 190 is rotatably mounted on a bolt 192 which extends through suitable holes in a lock washer 194 through the center hole in the wheel 190 itself, through another lock washer 196, and into a suitable threaded opening at each end of each spacer bar 186. A transversely entending applicator head bracket 198 extends between each pair of triangular plates and connects at its ends substantially in the center of each triangular plate by means of the bolts 200. To each bracket 198 there is attached a hollow powder applicator head 202. Each applicator head is relatively narrow at its inner end 204 and flares outwardly to a point of maximum width at a location corresponding to the position of the reference number 206 and then flares slightly inwardly to form an opening 208 which extends parallel to the longitudinal axis of the pipe 12 and which is not unlike the opening in a vacuum cleaner or a vacuum cleaner utensil. The narrow inner end 204 of each applicator head 202 is provided with a circular opening 210 to which is attached a hose 211. The connections for the other ends of the hoses 211 will be described hereinafter. An air cylinder 212 is connected between the center of each spacer bar 176 and the center of one of the inner spacer bars 166. As best shown in FIG. 5, each air cylinder 212 extends from the center of the links 172 to the spacer bar 168 (indicated by the location of the nut 170) on the opposite side of the center line of the arm 158. Each air cylinder 212 is provided with a cylinder portion 214 and a piston portion 216. At the end of the cylinder portion 214 opposite from the piston 216 are a pair of spaced ears 218 having openings through which the spacer bar 166 passes. Between each pair of ears 218 is a collar 220 which is received on the spacer bar and secured thereto by means of a suitable set screw (not shown). The outer end of the piston portion 216 is provided with a flattened projection 222 having a suitable hole through which the spacer bar 176 passes.

Referring now to the air cylinder 212 shown to the right on FIG. 5, this cylinder has a lower port 230 to which is attached an elbow 232 and a hose 234. The upper end of this cylinder 212 is provided with a port 236 to which is attached a tee 238 and an elbow 240 with hoses 242 and 244 being attached to the tee and elbow, respectively. The port 236 represents the "pressure" side of the piston 212; that is, when pressure is applied through the port 236, the air cylinder 212 will extend so as to urge the bottom linkage 172 in a counterclockwise direction forcing the wheels 190 on the bottom assembly against the surface of the pipe so as to position the lower applicator head 208 in closest proximity to the interior of the pipe.

With respect to the left hand air cylinder 212, this cylinder is provided with a port 246 at the radial inner end, or in the same frame of reference as employed with the right hand air cylinder, on the "pressure" side of the air cylinder. The port 246 connects with an elbow 248 and a hose 250. At the upper side or "exhaust" side of the left hand air cylinder 212 is a port 252 to which is connected a tee 254 and an elbow 256. Hoses 258 and 260 are connected to the tee and elbow, respectively. Although not shown on FIG. 5, the hose 244 is connected to a source of pressure such as the hose 90 in FIG. 1. This connection can be made directly or through a convenient control valve, as desired. The hose 242 also connects with the hose 250. Similarly, the hose 258 connects with the hose 234. In this mode, the hose 260 would connect to exhaust. Thus, when air pressure is applied to the hose 244, pressure is exerted on the upper end of the right hand cylinder 212 to extend the linkage outwardly and urge the lower wheel assembly against the inner surface of the pipe, as indicated above; when pressure is applied to the hose 244, pressure is also transmitted through hoses 242 and 250 into the lower side of the left hand piston air cylinder 212 urging the upper linkage upwardly against the surface of the pipe. Thus, the two air cylinders 212 are operating in parallel. Air within the right hand cylinder would be exhausted through the hose 234, through the hose 258, through the tee connection 254, and out the hose 260 (through which the left hand cylinder is also exhausted). If it were desired to reverse the operation; i.e., to retract the powder dispensing assemblies radially inward, the pressure conditions on the hoses 244 and 260 are reversed in any convenient manner. Thus, if pressure were applied to the hose 260 and the hose 244 were connected to exhaust, the pressure in the line 260 would urge the upper piston radially inwardly and the pressure would be transmitted through the hose 258, through the hose 234, to urge the right cylinder 212 radially inwardly thus bringing the two powder assemblies away from contact with the surface of the pipe.

Returning now to FIG. 1A of the drawings, a pair of air blowers 266, only one of which is shown, are mounted on the rear surface of the plate 20 on opposite sides of the center pipe 38. Each blower 266 is powered by a motor 268. Each blower 266 is provided with an outlet hose 270 which connects with a pipe 272 that passes through the plate 20 and connects with a hose 274 on the left hand side of the plate 20. Each hose 274 connects with a respective hose 211 shown on FIG. 5. Each pipe 272 is provided with an inlet pipe 280 connecting at right angles with the pipe 272. A hose 282 connects with this inlet pipe. The hose 282 also connects with the hose 138 which is the supply line from the powder valve 136. Thus, as air is forced through or is blown through the pipe 272 by means of the blower 266, each pipe 272 produces an eductor effect with respect to the tube 280 thus drawing powder into the tube 272 from the hose 282 which leads to the powder valve 136. Since there are two powder valves in parallel and two blowers 266 in parallel and since the hoses 274 are connected in parallel with the hoses 211, the two powder dispensers 202 are supplied each with a body of air in which powder is suspended.

Figure 6:
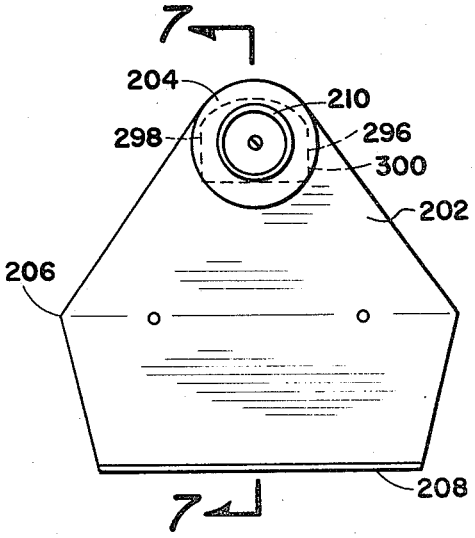
FIG. 6 is a partial front side elevation of one of the applicator heads shown in FIG. 1A.
Figure 7:
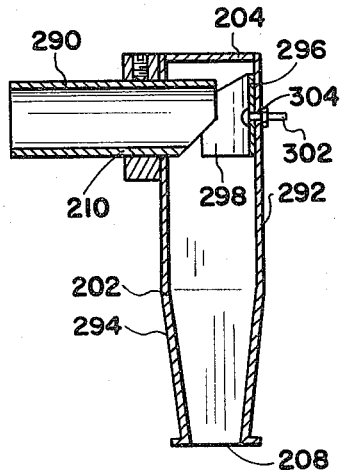
FIG. 7 is a sectional view taken along section line 7—7 of FIG. 6.

Referring now to FIGS. 6 and 7, the internal structure of one of the applicator heads 202 is shown in detail. The circular opening 210 (previously described) is defined by a pipe 290 to which the hose 211 (previously described) is actually applied. The pipe 290 extends inwardly into the interior of the applicator head 202 and terminates at a spaced distance from a wall 292 opposite from the inlet opening 210. A front wall 294, shaped in similar fashion, is spaced from the rear wall 292 as shown. Attached to the rear wall on the inside of the head 202 opposite the inner end of the pipe 290 is a piece of split tubing 296 which is actually one-half of a cylinder whose longitudinal central axis would be vertical as it appears in FIG. 7. The curved ends 298 and 300 extend around and envelope the inner end of the pipe 290. The split tubing 296 is attached by means of a bolt 302 and a nut 304 to the rear wall 292. The split tubing 296 forms a baffle for the powder coming in through the pipe 290. It was discovered, during the operation of this device, that there was a tendency for the powder coming in through the pipe 290 to impinge against the back wall 292 and spread out towards the outer edges of the head 202 so that, when issuing out of the opening 208, there would be a larger concentration of powder on the outside of the spray pattern. The baffle 296, however, provides a substantially uniform distribution of powder through the opening 208. Also, depending upon the angle at which the hose 211 connects in with the head 202, it is possible to rotate the baffle 296 slightly around the bolt 302 to obtain a more uniform spray pattern.

Referring now to FIG. 1C, the crawler section 18 includes an electric drive or motor 310, the details of which are considered to be unimportant as far as the present invention is concerned. The motor 310 drives a pair of wheels 312 through a suitable control mechanism (not shown). The electric motor 310 is powered by a plurality of batteries 316 which are supported on a rack 318 at the rear of the crawler section 18. The wheels 312 (only one of which is shown in FIG. 1C) are adapted to move the entire unit 10 inside the pipe to the desired location of a weld joint. Any convenient control means, electrical (such as shown in U.S. Pat. No. 4,092,950), radioactive, or otherwise will stop the rotation of the wheels 312 so that the forward coating section 16 will be properly positioned beneath the heated weld joint. The forward supporting portion 320 of the crawler unit 18 is conveniently secured, by bolting or welding, to the rear plate 22 shown in FIG. 1B.

Returning now to a further consideration of FIG. 1A, the powder dispensing assembly which has been described in relation to FIG. 1A and FIG. 5, is provided with a means for rotating the assembly around the front center pipe 32; this rotating means comprises an electrically powered motor 322 whose forward end is attached to a mounting plate 324 suspended from and connected forward of the carriage end plate 20 by means of a plurality of spacer bars 326 which are bolted at their forward ends to the mounting plate 324 and at their rear ends to the end plate 20. The motor 322 is conveniently connected to an electrical source of power (not shown) through a convenient control system (not shown) so as to operate in timed sequence to command from the controls. The motor 322 also has an internally built gear system which allows its output shaft (not referenced) to rotate at a relatively low rate of speed. This output shaft projects through the mounting plate 324 and is connected to a drive sheave or pulley 328. A somewhat larger driven sheave or pulley 330 is connected to the rear bearing housing 162. A V-belt 332 passes around the sheaves 328 and 330 so as to place the electric motor 322 in driving relation with the sheave 330. Thus, when the coating device shown in the drawings is properly positioned within the pipe so that the dispensing heads 202 are located opposite the weld joint (previously heated) to be coated, power is applied to the motor 322 to cause rotation of the sheaves 328 and 330 through the V-belt 332 and the entire assembly shown on FIG. 5 will rotate around the forward pipe 32 and powder will be sprayed out of the dispensing heads onto the heated weld joint (not shown). Because of the limited length of the hoses 211 which connect with the hoses 274 it is preferred that the rotation of the assembly shown in FIG. 5 be for less than one revolution. However, since there are two powder dispensers 202 on the assembly 180° apart, a 180° revolution of the assembly should provide a complete coating for the weld joint. In practice, the assembly is rotated in one rotary direction through suitable controls and then rotated in the opposite rotary direction, in each instance for about 180°.The alternate rotation of the assembly in one direction and then in the opposite direction can be repeated consecutively for as many times as desired to provide the required thickness of coating for the weld joint.

Under the above arrangement, the applicator heads can be moved closer to the weld joint than is the case in U.S. Pat. No. 4,092,950. Furthermore the applicator heads are maintained at a constant distance from the weld joint even when the pipe is out of round. Also the openings in the applicator heads are wider in the present case so as to provide better coverage over the weld joints.

Whereas the present invention has been described in particular relation to the drawings attached hereto, it should be understood that other and further modifications, apart from those shown or suggested herein, may be made within the spirit and scope of this invention.

What is claimed is:

1. An internal pipe coating apparatus for coating the interior surfaces of uncoated weld joints in an otherwise internally coated pipeline comprising a frame, means for moving the frame longitudinally along the interior of said pipeline, said frame having a forward end constituting a coating section adapted to be disposed in the area of an uncoated weld joint, said coating section having a shaft adapted to be disposed generally along the longitudinal center line of the pipeline and for rotatably mounting a coating assembly thereon, a coating assembly comprising an arm means mounted for rotation on said shaft and extending radially outward from said shaft on opposite sides thereof and terminating in a pair of opposite ends, link means connected to each opposite end of said arm means, each link means having an inner end pivotally connected to an opposite end of said arm means and having an outer end to which is pivotally connected a triangularly shaped mounting means, each mounting means being in the shape of an obtuse isosceles triangle having a single obtuse angle and a pair of smaller acute angles, each mounting means being pivotally connected to said link means at the apex of the obtuse angle, a wheel mounted on each mounting means at the location of each acute angle thereof, a hollow powder applicator head operatively connected to each mounting means, each applicator head having a dispensing opening oriented in a direction away from said shaft, a hose connected to each applicator head for supplying an air-powder mixture to said applicator head, expansion means operatively connected between center of each link means and said arms means adjacent said shaft for urging said link means outwardly away from said shaft, and means for rotating said arm means about said shaft.

2. An internal pipe coating apparatus as set forth in claim 1 wherein said arms means comprises a pair of horizontally spaced arms and a plurality of horizontally extending spacer bars disposed along the lengths of said arms for connecting said arms together whereby said arms will rotate in unison about said shaft, wherein said link means comprises a first pair of spaced parallel links having inner ends pivotally connected to one pair of opposite ends of said arms and a second pair of spaced links having inner ends pivotally connected to the other pair of opposite ends of said arms, wherein each mounting means comprises a pair of triangularly shaped mounting plates, each pair of mounting plates being pivotally connected to outer ends of said pairs of spaced links, each pair of mounting plates being connected by cross bars to each other so that each pair of mounting plates will pivot as a unit about the outer ends of said pairs of spaced links.

3. An internal pipe coating apparatus as set forth in claim 2 wherein each powder applicator head is connected to said mounting brackets by means of a transversely extending applicator head bracket extending between each pair of mounting brackets, each powder applicator head being mounted on an applicator head bracket.

4. An internal pipe coating apparatus as set forth in claim 2 wherein said expansion means comprises a piston-cylinder unit connected between each pair of links and said pair of arms, each piston-cylinder unit having one end operatively connected to a pair of links intermediate the ends thereof and having a second end operatively connected to the pair of arms adjacent the shaft, means for introducing fluid under pressure into each piston-cylinder unit to extend the same whereby the first end of each piston-cylinder unit moves outwardly away from the second end thereof so as to pivot said links outwardly away from said shaft until said wheels contact the inner surface of said pipeline and the dispensing openings of the applicator heads are positioned adjacent the weld joint.

5. An internal pipe coating apparatus for coating the interior surfaces of uncoated weld joints in an otherwise internally coated pipeline comprising a frame, means for moving the frame longitudinally along the interior of said pipeline, said frame having a forward end constituting a coating section adapted to be disposed in the area of an uncoated weld joint, said coating section having a shaft adapted to be disposed generally along the longitudinal center line of the pipeline and for rotatably mounting a coating assembly thereon, a coating assembly comprising a pair of horizontally spaced arms mounted for rotation on said shaft and being disposed in substantially parallel relation with each other, each arm extending radially outward from said shaft on opposite sides thereof and terminating in a pair of opposite ends, a plurality of horizontally extending spacer bars disposed along the length of said arms for connecting said arms together whereby said arms will rotate in unison about said shaft, a first pair of spaced parallel links having inner ends pivotally connected to one pair of opposite ends of said arms, said first pair of spaced links having outer ends to which are pivotally connected a first pair of triangularly shaped mounting plates, said first pair of mounting plates being arranged in spaced parallel relation and each being in the shape of an obtuse isosceles triangle having a single obtuse angle and a pair of smaller acute angles, each mounting plate of said first pair of mounting plates being pivotally connected to the outer end of its associated spaced link of said first pair of spaced links at the apex of the obtuse angle, a wheel mounted on each first mounting plate at the location of each acute angle thereof, a first pair of cross bars connecting the mounting plates of said first pair of mounting plates to each other so that said mounting plates will pivot as a unit about the outer ends of said first pair of spaced links, a first transversely extending applicator head bracket extending between the mounting brackets of said first pair of mounting brackets, a first hollow powder applicator head connected to said first applicator head bracket and having a dispensing opening oriented in a direction away from said shaft, a first hose connected to said first powder applicator head for supplying an air powder mixture to said first powder applicator head, a first piston-cylinder unit having one end operatively connected to said first pair of links intermediate the ends thereof and having a second end operatively connected to said pair of arms adjacent said shaft, means for introducing fluid under pressure into said first piston-cylinder unit to extend the same whereby the first end of said piston-cylinder unit moves outwardly away from said second end thereof so as to pivot said links outwardly away from said shaft until said wheels contact the inner surface of said pipeline and for locating the dispensing opening of said first applicator head adjacent said weld joint, a second pair of spaced parallel links having inner ends pivotally connected to one pair of opposite ends of said arms, said second pair of spaced links having outer ends to which are pivotally connected a second pair of triangularly shaped mounting plates, said second pair of mounting plates being arranged in spaced parallel relation and each being in the shape of an obtuse isosceles triangle having a single obtuse angle and a pair of smaller acute angles, each mounting plate of said second pair of mounting plates being pivotally connected to the outer end of its associated spaced link of said second pair of spaced links at the apex of the obtuse angle, a wheel mounted on each second mounting plate at the location of each acute angle thereof, a second pair of cross bars connecting the mounting plates of said second pair of mounting plates to each other so that said mounting plates will pivot as a unit about the outer ends of said second pair of spaced links, a second transversely extending applicator head bracket extending between the mounting brackets of said second pair of mounting brackets, a second hollow powder applicator head connected to said second applicator head bracket and having a dispensing opening oriented in a direction away from said shaft, a second hose connected to said second powder applicator head for supplying an air powder mixture to said second powder applicator head, a second piston-cylinder unit having one end operatively connected to said second pair of links intermediate the ends thereof and having a second end operatively connected to said pair of arms adjacent said shaft, means for introducing fluid under pressure into said second piston-cylinder unit to extend the same whereby the second end of said piston-cylinder unit moves outwardly away from said second end thereof so as to pivot said links outwardly away from said shaft until said wheels contact the inner surface of said pipeline and for locating the dispensing opening of said second applicator head adjacent said weld joint, and means for rotating said arms about said pipeline.

* * * * *